United States Patent [19]

Schomer et al.

[11] 4,347,410

[45] Aug. 31, 1982

[54] MICROPHONE DROOP AND SENSITIVITY MEASUREMENT DEVICE

[76] Inventors: Paul D. Schomer, 2117 Robert Dr., Champaign, Ill. 61820; Alan B. Hunt, 326 Townsend Hall U.R.H., Urbana, Ill. 61801

[21] Appl. No.: 124,873

[22] Filed: Feb. 26, 1980

[51] Int. Cl.[3] ..... H04R 29/00

[52] U.S. Cl. ..... 179/175.1 A

[58] Field of Search ..... 179/175.1 A, 111 R; 73/801, 1 DV, 412; 340/544, 626

[56] References Cited

U.S. PATENT DOCUMENTS

| | | | |
|---|---|---|---|
| 2,530,383 | 11/1950 | Estes et al. | 179/175.1 A |
| 3,093,711 | 6/1963 | Comerci et al. | 179/175.1 A |
| 3,267,222 | 8/1966 | Chipp et al. | 179/175.1 A |
| 3,281,543 | 10/1966 | Clay et al. | 179/175.1 A |
| 3,744,294 | 7/1973 | Lewis et al. | 179/175.1 A |
| 3,912,880 | 10/1975 | Powter et al. | 179/175.1 A |

*Primary Examiner*—Thomas A. Robinson

*Attorney, Agent, or Firm*—Darrell E. Hollis

[57] ABSTRACT

A device for measuring microphone sensitivity and droop by subjecting the microphone to a negative step function input and recording the microphone electrical response thereto. The microphone is surrounded by an inflated thin, flexible, expandable membrane. The membrane is ruptured resulting in an instantaneous reduction in air pressure on the microphone. It is this instantaneous reduction in air pressure that constitutes the negative step function input to the microphone.

72 Claims, 6 Drawing Figures

FIG. 1
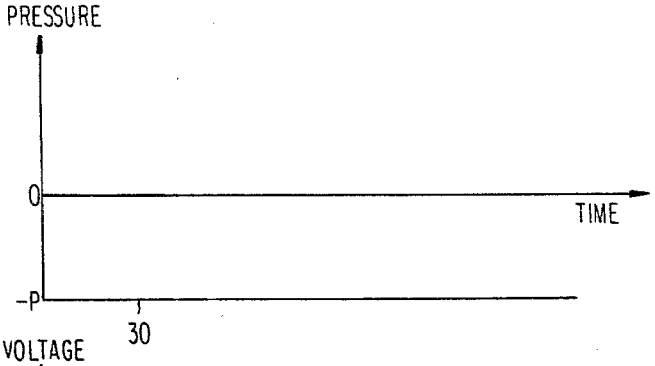
FIG. 2
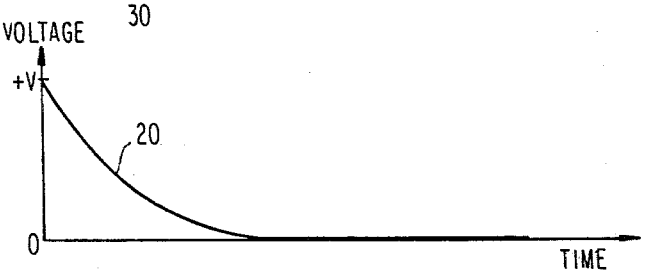
FIG. 3
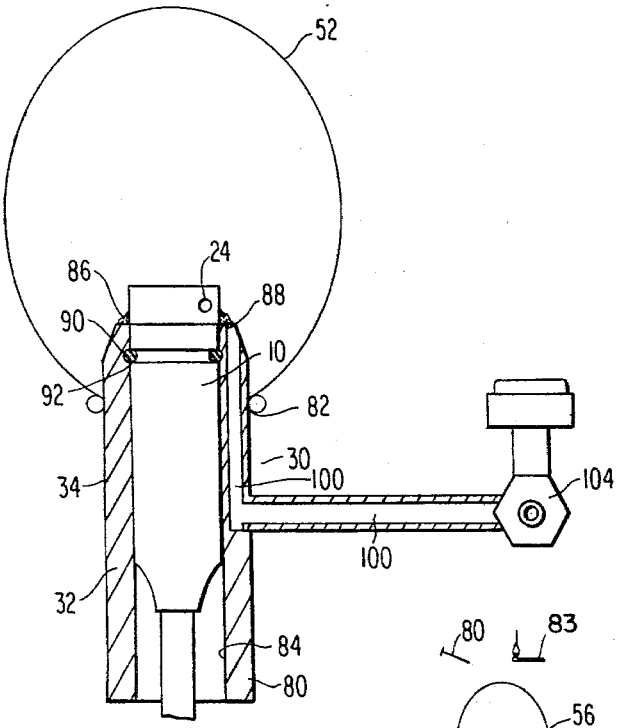
FIG. 4
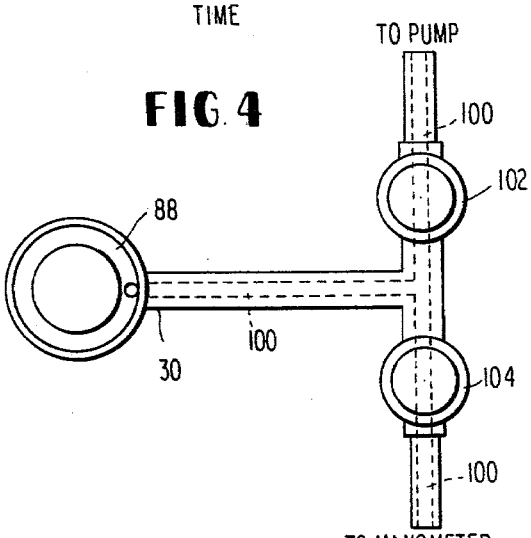
FIG. 6
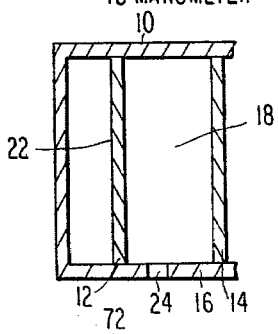
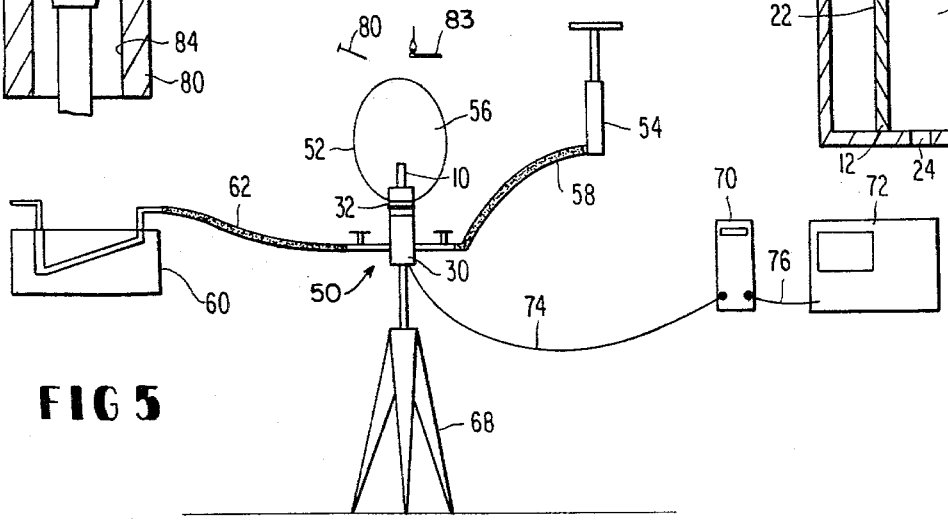
FIG 5

MICROPHONE DROOP AND SENSITIVITY MEASUREMENT DEVICE

BACKGROUND OF THE INVENTION

1. Field of the Invention

The present invention relates to an apparatus for measuring the properties of acoustical transducers and, more particularly, to an apparatus for measuring sensitivity and droop in a condenser microphone in such a manner that a more accurate measurement of the sensitivity and low frequency cutoff of the microphone can be made than heretofore was possible.

The peak amplitude and subsequent droop constitute the electrical response of a microphone to a step function input. When a positive or negative step function input is applied to a microphone in the form of an sudden or instantaneous increase or decrease in air pressure, the microphone voltage output will show the leading edge of the step function. However, the voltage output will decay from the instantaneous peak level back to the original zero level. This rate of this decay is defined as droop and may be used to determine the low cutoff frequency of the microphone. The instantaneous peak voltage level determines the microphone sensitivity.

The cause of this decay is found in the construction of the microphone. Condenser microphones are constructed with a movable plate and a fixed plate parallel to each other surrounded by a housing thereby defining a cavity between the parallel plates. The movable plate is subject to physical deformation in response to changes or differentials in air pressure between the cavity and the outside face of the movable plate. A small orifice or vent located in the housing equalizes the air pressure within the cavity with that exerted on the microphone outside the cavity.

When a positive or negative step function is applied to the microphone, the movable plate is displaced resulting in a voltage output from the microphone. The orifice or vent described above equalizes the air pressure in the cavity with the air pressure exerted on the microphone from outside the cavity. As this happens, the movable plate returns to its original position at a rate determined by the orifice size and the volume of the cavity. Of course, as the movable plate return to its original position the voltage output of the microphone decays to zero or a reference level. This rate of decay is the droop of the microphone.

2. Description of the Prior Art

Devices heretofore employed for the purpose of measuring droop in condenser microphone have suffered from the mechanical limitation introduced by the utilization of a positive step function input for testing and measuring purpose.

In particular, to apply a positive step function input to a condenser microphone, the microphone must be placed in an rigid, airtight enclosure or housing and the pressure within the enclosure quickly increased and maintained at a constant level. This requires a mechanical system capable of increasing the pressure quickly enough to effect the fast rise time that is required to minimize pressure equalization via the microphone housing orifice while the positive step function is being applied. Notwithstanding the fact that such prior art mechanical systems are complex and expensive to build they additionally suffer from the slow response limitations inherent in all mechanical systems which prevents them from achieving an acceptably fast rise time.

In addition, when a condenser microphone is placed in a rigid enclosure, the microphone is subject to reflections or acoustic noise resulting from pressure waves bouncing off the surfaces of the enclosure surrounding the microphone. These reflections or noise signals result in distortions or noise signals appearing in the electrical response of the microphone to the positive step input thereby introducing inaccuracies into the droop measurement as well as the sensitivity measurement.

Also an accurate method of controlling and measuring the step pressure level is necessary when making droop and sensitivity measurements. Prior art devices are unable to effect accurate measurement and control of the step pressure level at the low pressures needed to test the microphone.

SUMMARY OF THE INVENTION

The present invention overcomes the above-described disadvantages and limitations by utilizing a negative step function input to measure microphone sensitivity and droop as opposed to the use of a positive step function input.

In particular, the present invention comprehends surrounding the condenser microphone or acoustic transducer with a thin, expandable, flexible membrane inflated to a desired presure. This flexible membrane is ruptured resulting in an instantaneous reduction in air pressure between the microphone cavity and the outside face of the movable plate. This instantaneous reduction in air pressure results in the step function input to the microphone having a faster rise time than has heretofore been achievable. Hence, the present invention achieves a more accurate, less complex and less expensive droop measurement device that is capable of operation at lower pressure levels than can be achieved utilizing prior art devices.

Accordingly one object of the present invention is to provide a device for microphone droop and sensitivity measurement.

Another object of the present invention is to provide a device for measuring microphone droop and sensitivity utilizing a negative step function input.

A further object of the present invention is to provide a droop and sensitivity measuring device capable of producing a step function input having an instantaneous rise time at low pressure levels.

A still further object of the present invention is to provide an accurate droop and sensitivity measuring device.

Another object of the present invention is to provide a droop and sensitivity measuring device which minimizes noise.

A further object of the present invention is to provide an inexpensive droop and sensitivity measuring device.

A still further object of the present invention is to provide a device for applying an instantaneous reduction in pressure to an acoustical transducer.

Another object of the present invention is to provide a device for measuring microphone sensitivity.

Other objects and a more complete appreciation of the present invention and its many attendant advantages will develop as the same becomes better understood by reference to the following detailed description when considered in connection with he accompanying drawings in which like reference numbers represent like parts throughout.

BRIEF DESCRIPTION OF THE DRAWINGS

FIG. 1 is a graphic representation of a negative step function input.

FIG. 2 is a graphic representative of the electrical output of the microphone in response to the input shown in FIG. 1.

FIG. 3 is a partial cross-sectional side view of the adapter.

FIG. 4 is a top view of the adapter illustrated in FIG. 3.

FIG. 5 is a diagrammatical view of one embodiment of the present invention for making droop and sensitivity measurements.

FIG. 6 is a partial cross-sectional view of a condenser microphone.

DETAILED DESCRIPTION OF THE PREFERRED EMBODIMENT

Referring now to FIGS. 1,2 and 6, there is illustrated in FIG. 6 an acoustical transducer or condenser microphone generally designated by the reference numeral 10.

Droop is the electrical response as shown by line 20 in FIG. 2 of condenser microphone 10 of FIG. 6 to a step function input. When a positive or negative step function input is applied to microphone 10 in the form of a sudden or instantaneous increase or decrease in air pressure, microphone 10's voltage output will show the leading edge of the step function as illustrated in FIG. 2. As shown in FIG. 1, line 30 represents graphically a negative step function input created by an instantaneous reduction in air pressure. The electrical output 20 shown in FIG. 2 is positive because microphone 10 is inverting so a negative input results in a positive output. However, as shown by line 20 of FIG. 2 the voltage output will decay from the new level V back to the original zero or reference level. This rate of decay is defined as droop and may be utilized to determine the low-frequency cutoff of microphone 10.

The cause of this decay is found in the construction of microphone 10. Microphone 10 comprises a movable plate 12 and a fixed plate 14 parallel to each other surrounded by a housing 16 thereby defining a cavity 18 between parallel plates 12 and 14. Movable plate 12 is subject to physical deformation in response to changes or differentials in air or fluid pressure between the pressure contained in cavity 18 and the pressure exerted on outside face 22 of movable plate 12. Small orifice or vent 24 located in housing 16 provides fluidic communication between cavity 18 and the ambient pressure.

When negative step function 30 of FIG. 1 is applied to microphone 10, movable plate 22 is displaced resulting in the peak voltage output V of FIG. 2. Orifice or vent 24 equalizes the air pressure in cavity 18 with the ambient air pressure, i.e. upon equalization any pressure gradient existing between the pressure in cavity 18 and the pressure exerted on microphone 10 from outside cavity 18 is destroyed. As this equalization occurs, movable plate 12 returns to its original position at a rate determined by the cross-sectional area and length of orifice 24 and the volume of cavity 18. As movable plate 12 returns to its original position the voltage output of microphone 10 drops from its peak level V to zero or a reference level as is illustrated by line 20 in FIG. 2. It is this rate of decay that constitutes the droop of microphone 10 and from which the low frequency cutoff of microphone 10 can be determined.

Now referring to FIG. 5 microphone droop and sensitivity measuring device 50 is illustrated in diagrammatical form. In particular, condenser microphone 10 is emplaced in adapter 30 with adapter 30 being supported by tripod 68. Adapter 30 is illustrated in greater detail in FIGS. 3 and 4. A thin flexible membrane 52 abuts adapter 30 about portion 82 of outside surface 34 of tube 32 of adapter 30 forming an airtight seal between membrane 52 and surface 34.

Air pump 54, which is illustrative of a source of fluidic pressure, is in fluidic communication, through adapter 30 and flexible hose 58, with interior 56 of membrane 52. Air pump 54 inflates membrane 52 thereby placing an air pressure on microphone 10 greater than the ambient or atmospheric pressure.

The mean static pressure created within interior 56 of membrane 52 is monitored by manometer 60. Manometer 60 is in fluidic communication with interior 56 of membrane 52 via flexible hose 62 and adapter 30. Thus, as air pump 54 increases the air pressure inside membrane 52 manometer 60 measures this increase versus the ambient or atmospheric pressure thereby providing an extremely sensitive and accurate record of the amount of instantaneous air pressure reduction microphone 10 will be subjected to upon the rupture of membrane 52.

The electrical response of microphone 10 to this instantaneous reduction in air pressure is measured and recorded by instrumentation familiar to those persons having ordinary skill in the art. FM carrier generator 70 and storage oscilloscope 72 comprise one example of such instrumentation. The electrical output of microphone 10 is coupled to FM carrier generator 70 via line 74. The output of FM carrier generator 70 is coupled to oscilloscope 72 via line 76. The trace appearing on oscilloscope 72 is illustrated graphically by line 20 of FIG. 2.

After membrane 52 is inflated to the desired air pressure level, monitored by manometer 60, the air pressure level is measured and converted to db for later comparison with the peak voltage level V (shown in FIG. 2) measured by oscilloscope 72 in order to define the sensitivity of microphone 10. The sensitivity of microphone 10 is defined as the peak output voltage level of microphone 10 (V in FIG. 2) divided by the pressure measured by manometer 60. In other words, the sensitivity is the peak output voltage per unit of pressure. Next the membrane 52 is ruptured and the electrical response is recorded by storage oscilloscope 72. An exemplary trace from oscilloscope 72 is shown by line 20 in FIG. 2. From this trace, the time constant for the decay is measured. This time constant is then converted into the low frequency cutoff for microphone 10.

The technique utilized to rupture membrane 50 is of utmost importance if extremely accurate measurements are desired. For example, if membrane 52 is punctured by a pin 80 or another mechanical object having a sharp surface or edge, e.g. a blade, an additional pressure will be exerted on membrane 52 which will be translated into an increased pressure on microphone 10. This increase in pressure will appear in the trace of oscilloscope 72 thereby introducing noise or error into the sensitivity and droop measurements. Ideally, membrane 52 should be ruptured without the application of any mechanical force to its surface. This is accomplished by the placement of a source of heat such as lighted match 83 in close proximity to membrane 52 thereby resulting in the rupture of membrane 52 without the increase in air pressure attendant with the use of pin 80. In addition, a heat source such as match 83 will not noticeably raise the temperature of the air or fluid within membrane 52 thereby increasing the air pressure which could result in an inaccurate measurement of droop and sensitivity.

The level or magnitude of the pressure inside membrane 52 is significant because for the data, i.e. the oscilloscope trace, to be meaningful the droop must be measured at the low pressure levels present when microphone 10 is in actual use. The utilization of inflated membrane 52 in cooperation with the rupture of membrane 52 by a heat source such as match 83 to apply a negative step function input to microphone 10 provides a droop and sensitivity measurement device capable of making these measurements with greater accuracy than any heretofore known prior art droop and sensitivity measurement device.

Now turning to FIGS. 5, 3 and 4 the physical characteristics of adapter 30 and microphone 10 are illustrated in greater detail. As shown in FIG. 3 a portion of adapter 30 comprises a tube 32 having an outside surface 34 and an inside surface 84. Membrane 52 abuts outside surface 34 about portion 82 thereof thereby forming an airtight or fluid tight seal therebetween.

Microphone 10 is disposed within tube 80 abutting inside surface 84 thereof. A sealant material 86 is placed between housing 16 of microphone 10 at end surface 88 of tube 80 to provide a fluid tight seal therebetween. In addition, O-ring seal 90 disposed within circumferential groove 92 located on inside surface 84 abuts housing 16 of microphone 10 thereby providing an additional fluid tight seal. However, it is noted that vent or orifice 24 is not sealed but rather open for communicating the fluidic pressure within membrane 52 to cavity 18 within microphone 10.

Passageway 100 provides fluidic communication between pump 54 and manometer 60 and the interior of membrane 52 through adapter 30. Valves 102 and 104 are utilized to control fluidic flow to inflating membrane 52.

Thin flexible expandable membrane 52 may be fabricated from any suitable thin flexible expandable material such as rubber or a rubber compound. The membrane 52 is similar in operation to a toy balloon that expands upon the injection of air thereinto. Adapter 30 may be fabricated from any acceptable rigid material such as plastic, wood, metal, etc.

As can be seen from the above description, applicants' invention is capable of producing the fast rise time necessary to minimize pressure equalization through orifice 24 while the negative step function input is being applied that prior art devices utilizing a positive step function input have been unable to achieve. In addition, applicants' invention does not suffer data degradation from secondary pressure waves reflected from surfaces surrounding the microphone as do prior art devices. Also, applicants' invention is capable of making droop and sensitivity measurements at the low pressures a microphone will experience during actual use which prior art devices have been unable to achieve.

It is envisioned that the use of applicants' invention is not restricted to testing droop and sensitivity in condenser microphones but can be utilized to test any acoustical transducer where an instantaneous reduction is fluidic pressure is desired.

Obviously many modifications and variations of the present invention are possible in light of the above teachings. It is therefore to be understood that within the scope of the appended claims the invention may be practiced otherwise than as specifically described.

We claim:

1. An apparatus comprising
(a) an acoustical transducer; and
(b) means for subjecting said transducer to a reduction in fluidic pressure at a fast rate such that an acoustic negative step function input is applied to said transducer.

2. The apparatus of claim 1 wherein said reduction in fluidic pressure is instantaneous.

3. The apparatus of claim 1 or 2 wherein said fluidic pressure is reduced from a first specific magnitude to a reference magnitude.

4. The apparatus of claim 1 or 2 wherein said acoustical transducer comprises a condenser microphone.

5. The apparatus of claim 4 wherein said condenser microphone comprises
(a) a first movable plate;
(b) a second immovable plate; and
(c) a microphone housing adjacent to said first and second plates defining a cavity between said first and second plates, said housing having an orifice therethrough for venting air from said cavity.

6. The apparatus of claim 5 wherein said fluidic pressure subjecting means comprises,
(a) means, enclosing a portion of said housing including said orifice, for expanding when inflated with a fluid;
(b) means for inflating said expandable means with a fluid; and
(c) means for deflating said expandable means thereby effecting said reduction in fluidic pressure.

7. The apparatus of claim 6 wherein said means for deflating includes means for rupturing said expandable means.

8. The apparatus of claim 7 wherein said rupturing means includes non-mechanical means.

9. The apparatus of claim 8 wherein said non-mechanical means includes a source of heat.

10. The apparatus of claim 7 wherein said rupturing means includes mechanical means applied to said expandable means.

11. The apparatus of claim 10 wherein said mechanical means includes an object having a sharp surface.

12. The apparatus of claim 6 wherein said expandable means includes a thin expandable membrane.

13. The apparatus of claim 12 wherein said membrane includes a balloon.

14. The apparatus of claim 6 wherein said means for inflating comprises,
(a) an adapter having a passageway for providing fluidic communication from the interior of said expandable means to the exterior of said expandable means; and
(b) a source of fluidic pressure coupled to said adapter passageway.

15. The apparatus of claim 14 wherein said adapter is disposed between said microphone housing and said expandable means.

16. The apparatus of claim 15 wherein said adapter includes,
(a) a tube having an inside surface and an outside surface, said microphone housing abutting said inside surface and said expandable means abutting said outside surface; and (b) means for effecting a fluidic seal between said microphone housing and said inside surface below said venting orifice.

17. The apparatus of claim 16 wherein said fluidic seal means includes an O-ring.

18. The apparatus of claim 14 further comprising a valve coupled between said source of fluidic pressure and said adapter passageway for controlling the fluidic inflation of said expandable means.

19. The apparatus of claim 14 further comprising monitoring means communicating with said passageway for measuring said fluidic pressure within said expandable means.

20. The apparatus of claim 19 wherein said monitoring means includes a manometer.

21. The apparatus of claim 19 further comprising a valve coupled between said measuring means and said passageway for controlling said measuring means.

22. The apparatus of claim 6 wherein said fluidic pressure subjecting means further includes monitoring means for measuring the fluidic pressure within said expandable means.

23. The apparatus of claim 22 wherein said monitoring means includes a manometer.

24. The apparatus of claim 1 or 2 wherein said fluidic pressure subjecting means comprises, (a) means, enclosing said acoustical transducer, for expanding when inflated with a fluid;

(b) means for inflating said expandable means with a fluid; and (c) means for deflating said expandable means thereby effecting said reduction in fluidic pressure.

25. The apparatus of claim 24 wherein said means for deflating includes means for rupturing said expandable means.

26. The apparatus of claim 25 wherein said rupturing means includes non-mechanical means.

27. The apparatus of claim 26 wherein said non-mechanical means includes a source of heat.

28. The apparatus of claims 24 wherein said rupturing means includes mechanical means applied to said expandable means.

29. The apparatus of claim 28 wherein said mechanical means includes an object having a sharp surface.

30. The apparatus of claim 24 wherein said expandable means includes a thin expandable membrane.

31. The apparatus of claim 30 wherein said membrane includes a balloon.

32. The apparatus of claim 24 wherein said means for inflating comprises, (a) an adapter defining a passageway for providing fluidic communication from the interior of said expandable means to the exterior of said expandable means; and (b) a source of fluidic pressure coupled to said adapter passageway.

33. The apparatus of claim 32 wherein said adapter is disposed between said transducer and said expandable means.

34. The apparatus of claim 33 wherein said adapter includes, (a) a tube having an inside surface and an outside surface; said transducer abutting said inside surface and said expandable means abutting said outside surface; and (b) means for effecting a fluidic seal between said transducer and said inside surface.

35. The apparatus of claim 34 wherein said fluidic seal means includes an O-ring.

36. The apparatus of claim 32 further comprising a valve coupled between said source of fluidic pressure and said adapter pasageway for controlling the fluidic inflation of said expandable means.

37. The apparatus of claim 32 further comprising monitoring means communicating with said passageway for measuring said fluidic pressure within said expandable means.

38. The apparatus of claim 37 wherein said monitoring means includes a manometer.

39. The apparatus of claim 37 further comprising a valve coupled between said monitoring means and said passageway for controlling said monitoring means.

40. The apparatus of claim 24 wherein said fluidic pressure subjecting means further includes monitoring means for measuring the fluidic pressure within said expandable means.

41. The apparatus of claim 40 wherein said monitoring means includes a manometer.

42. The apparatus of claim 1 or 2 further including means for measuring and recording the electrical output signal from said transducer.

43. The apparatus of claim 42 wherein said measuring and recording means includes an FM carrier generator and an oscilloscope.

44. The apparatus of claim 1 or 2 wherein said subjecting means further includes monitoring means for measuring said fluidic pressure exerted on said transducer.

45. The apparatus of claim 44 wherein said monitoring means includes a manometer.

46. A method of measuring droop and sensitivity in a condenser microphone comprising the step of subjecting the microphone to an instantaneous reduction in fluidic presure whereby an acoustic negative step function is applied to said microphone.

47. The method of claim 46 wherein the step of subjecting includes the steps of (a) creating an air-tight seal between said microphone and a thin, expandable, flexible membrane;

(b) inflating said membrane to a specific pressure level; and (c). rupturing said membrane thereby applying an instantaneous reduction in air pressure to said microphone.

48. The method of claim 47 wherein the step of rupturing includes utilizing non-mechanical means for rupturing said membrane.

49. An apparatus comprising (a) an acoustical transducer;

(b) means for applying a positive fluidic pressure with respect to the ambient pressure to said transducer; and (c) means for reducing said positive fluidic pressure at a fast rate such that an acoustic negative step function is applied to said transducer.

50. The apparatus of claim 49 wherein said positive pressure applying means includes (a) means, enclosing said acoustical transducer, for expanding when inflated with a fluid; and (b) means for inflating said expandable means with a fluid.

51. The apparatus of claim 50 wherein said pressure reducing means includes means for deflating said expandable means.

52. The apparatus of claim 51 wherein said deflating means includes means for rupturing said expandable means.

53. The apparatus of claim 52 wherein said rupturing means includes non-mechanical means.

54. The apparatus of claim 53 wherein said non-mechanical means include a source of heat.

55. The apparatus of claim 52 wherein said rupturing means includes mechanical means applied to said expandable means.

56. The apparatus of claim 55 wherein said mechanical means includes an object having a sharp surface.

57. The apparatus of claim 50 wherein said expandable means includes a thin expandable membrane.

58. The apparatus of claim 57 wherein said membrane includes a balloon.

59. The apparatus of claim 50 wherein said means for inflating comprises, (a) an adapter defining a passageway for providing fluidic communication from the interior of said expandable means to the exterior of said expandable means; and (b) a source of fluidic pressure coupled to said adapter passageway.

60. The apparatus of claim 59 wherein said adapter is disposed between said transducer and said expandable means.

61. The apparatus of claim 60 wherein said adapter includes, (a) a tube having an inside surface and an outside surface; said transducer abutting said inside surface and said expandable means abutting said outside surface; and (b) means for effecting a fluidic seal between said transducer and said inside surface.

62. The apparatus of claim 61 wherein said fluidic seal means includes an O-ring.

63. The apparatus of claim 59 further comprising a valve coupled between said source of fluidic pressure and said adapter passageway for controlling the fluidic inflation of said expandable means.

64. The apparatus of claim 59 further comprising monitoring means communicating with said passage for measuring said fluidic pressure within said expandable means.

65. The apparatus of claim 64 wherein said monitoring means includes a manometer.

66. The apparatus of claim 64 further comprising a valve coupled between said monitoring means and said passageway for controlling said monitoring means.

67. The apparatus of claim 49 wherein said positive fluidic pressure applying means further includes monitoring means for measuring the fluidic pressure within said expandable means.

68. The apparatus of claim 67 wherein said monitoring means includes a manometer.

69. The apparatus of claim 49 further including means for measuring and recording the electrical output signal from said transducer.

70. The apparatus of claim 69 wherein said measuring and recording means includes a FM carrier generator and an oscilloscope.

71. The apparatus of claim 49 wherein said positive fluidic pressure applying means further includes monitoring means for measuring said fluidic pressure exerted on said transducer.

72. The apparatus of claim 71 wherein said monitoring means includes a manometer.

* * * * *